United States Patent [19]

Walsh

[11] Patent Number: 4,768,834

[45] Date of Patent: Sep. 6, 1988

[54] METHOD AND APPARATUS FOR MAINTAINING OPTIMUM LUMBAR SPINAL ALIGNMENT WHILE SEATED

[76] Inventor: Andrew C. Walsh, 12 Stornoway Rd., Cumberland Foreside, Me. 04110

[21] Appl. No.: 916,863

[22] Filed: Oct. 9, 1986

Related U.S. Application Data

[63] Continuation-in-part of Ser. No. 712,081, Mar. 15, 1985, abandoned.

[51] Int. Cl.[4] ..... A47C 31/00

[52] U.S. Cl. ..... 297/466

[58] Field of Search ..... 297/464, 466, 468, 465, 297/467, 487, 474, 475, DIG. 4, 216; 128/133, 134, 68, 78

[56] References Cited

U.S. PATENT DOCUMENTS

| | | | |
|---|---|---|---|
| 3,063,447 | 11/1962 | Kirsten | 128/134 |
| 3,474,781 | 10/1969 | Gaylord, Jr. | 297/466 |
| 4,214,790 | 7/1980 | Sieber | 297/464 X |
| 4,509,797 | 4/1985 | Mullaly | 297/466 |
| 4,510,634 | 4/1985 | Diedrich | 297/464 X |

FOREIGN PATENT DOCUMENTS

| | | | |
|---|---|---|---|
| 2845870 | 5/1980 | Fed. Rep. of Germany | 297/DIG. 4 |

*Primary Examiner*—James T. McCall

*Attorney, Agent, or Firm*—Nutter, McClennen & Fish

[57] ABSTRACT

Optimum lumbar alignment is achieved and maintained in a human subject through forced contraction of the subject's psoas major muscles while in a seated position. A flexible thigh strap attached to a seat or chair in which the subject seats restrains the anterior portions of the subject's thighs proximate the subject's knees from upward movement. The human subject forces his thighs upwardly against the strap and forces the balls of his feet downwardly against the ground or floor on which the seat or chair is supported. This causes the subject's psoas major muscles to flex and produces a flattening of his/her lumbar spine which assists in relieving chronic backache.

6 Claims, 1 Drawing Sheet

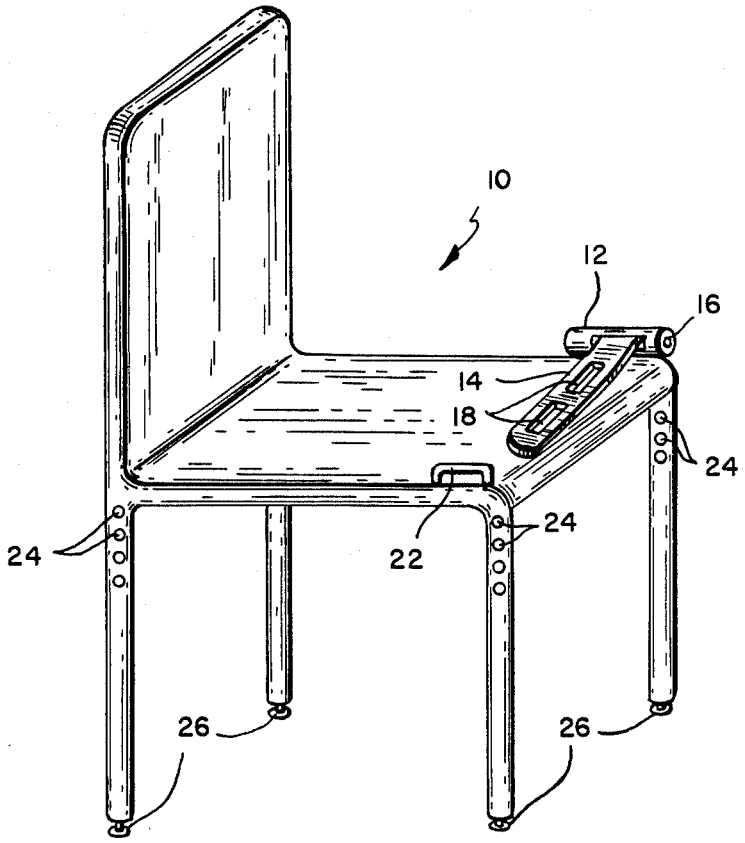
10
12
16
14
18
24
24
24
22
26
26

METHOD AND APPARATUS FOR MAINTAINING OPTIMUM LUMBAR SPINAL ALIGNMENT WHILE SEATED

RELATED APPLICATION

This application is a continuation-in-part of application Ser. No. 712,081 filed on Mar. 15, 1985.

FIELD OF THE INVENTION

This invention relates to a method and apparatus for distributing weight bearing on the low back while in the seated position. This can be extremely helpful for an individual with chronic low back pain. In particular, it would be helpful in long periods of travel as in automobiles (for example, as an attachment to the front passenger seat) or in airplane seats. It would also be helpful at home as well as in the workplace in jobs requiring prolonged periods of sitting.

BACKGROUND OF THE INVENTION

The lumbar spinal vertabrae, five in number, are individual bones situated one on the next like building blocks. See, for example, *Gray's Anatomy,* 1901 Edition, Running Press (1974), pp. 34–54, particularly FIG. 22 at p. 51. They are, however, separated one from the other by intervertebral fibro-cartilages or discs. Such discs function like shock absorbers separating the bony vertabrae. The fifth or last lumbar vertabra is separated from the sacrum by the last intervertebral disc. Flexibility of the spinal (vertabrae) column is controlled in large measure by the intervertebral discs. Stability in this flexible rod is maintained in large measure by muscles and ligaments appropriately positioned.

The vertabrae consist of a body with which the discs are in direct contact and posterior elements or portions of the vertabrae which are offset behind the vertabrae body. Names are ascribed to the portions of the posterior elements, i.e., pedicles, laminae, spinous processes and facet joints. See *Gray's Anatomy,* supra, pp. 34–36, 41–43, FIGS. 7 and 8.

The intervertebral discs function particularly to cushion the vertical stress or pressure on the spinal column. The facet joints, however, serve in large measure to prevent the forward shifting or slippage of one vertabra on another. They do, however, absorb some vertical weight bearing pressure.

The spinal column is not a straight vertical rod. See *Gray's Anatomy,* supra, p. 51, FIG. 22. The curvatures of the spine enhance its vertical stability in the erect attitude. The lowermost curve, known as the lumberlordosis, is the forward convex attitude that the lumbar vertabrae makes with the sacrum. The normal curves allow for optimum pressure distribution on the intervertebral discs, near the center of the discs, and lessen contact pressure on the facet joints. These facet joints are lined by cartilagenous plates of smooth surface consistency. One might liken it to "Formica surface" protection. A small lubricating sac like "a deflated balloon" is interposed between the facet joints contact surfaces. This arrangement allows for smooth shifting of one facet surface on the next as in bending and twisting. Such bending and twisting also exerts varying degrees of pressure on different parts of the intervertebral discs. Proportionally more stress (pressure) is exerted on the disc between the fifth lumbar vertabra and the sacrum.

The intervertebral disc consists of a fairly tough outer casing and a soft core or central portion in childhood and early adult life. As years pass, and particularly depending on degree of physical stress imposed on the lumbar spine, a process of gradual deterioration occurs in the disc. Partial dehydration of the soft core causes partial deflation (shrinkage) of the disc and in the process loss of some of its shock absorbing capacity. This results in a settling effect of one vertabra on the next and in an increasing weight bearing on the facet joints. This increasing pressure on the contact surfaces as the result of compromise of the shock absorbing capacity of the disc leads to reactive wearing down of the cartilagenous plates on the facet joint's contact surfaces with resulting exposure of the cortical or outer surface of bone normally protected by the cartilagenous plates. This exposure causes irregular outgrowth of bone referred to as reactive spurring and sclerosis. This results in a roughening of the contact surfaces. Such compromised surfaces are more vulnerable to injury or trauma than are the young healthy joints, and when these worn compromised surfaces on the vertabrae are so injured, it results frequently in greater lower back pain, requiring more difficult and protracted periods of treatment. In essence, the facet joints so injured can cause long periods of fluctuating discomfort which increases at greater levels of activity, particularly repeated or sustained bending or lifting. Obesity, pregnancy and other situations which tend to increase the lumbar lordosis (swayback) can further aggravate the problem of excessive facet pressure.

SUMMARY OF THE INVENTION

This invention is based upon the recognition that controlling the lordotic or forward convex curve in the lumbar area of the spine can favorably affect the pressure on the facet joints of the vertabrae, and that such control can rather easily and effectively be achieved through forced contraction of the psoas major muscles that occupy each side of the lumbar spine. Forced contraction of the psoas major muscles is accomplished in accordance with the invention through means that fix or restrain the fronts or anterior portions of the thighs proximate the knees against upward movement when an individual is in the seated position. The restraining means are positioned proximate the individual's knees so as to maximize the effective lever arm of the thighs in contracting the psoas major muscles. When an individual occupies a seat/chair to which restraining means of this type and in this manner have been fixed, he or she forces his or her thighs upwardly against the restraining means and the balls of his or her feet downwardly against the floor or ground on which the seat/chair is supported to contract the upper or lumbar portions of the psoas major muscles. This forced contraction of the psoas major muscles causes them to function as lumbar flexors that flatten the lumbar spine. This helps the individual to achieve and maintain optimum lumbar spinal alignment while seating which is effective in relieving chronic backache.

BRIEF DESCRIPTION OF THE DRAWING

The foregoing and other features and advantages of this invention will be better understood from the following detailed description taken in conjunction with the accompanying drawing in which the sole FIGURE is a perspective illustration of a seat/chair thigh strap arrangement for providing the desired restraint against upward movement of the anterior portions of the thighs proximate the knees when an individual is in the seated position.

DETAILED DESCRIPTION

The psoas magnus or major muscles arise from the lateral margins of the lumbar vertebrae, descend across the brim of the pelvis and enter the thigh behind the ingunial ligament. See *Gray's Anatom,* supra, pp. 364–367, FIG. 221; pp. 415–418, 420, FIG. 253. Their lower part tendons attach to the lesser trochanter of the femur. Each muscle functions to flex the corresponding hip as in walking. If however the hips are fixed, contraction of the psoas muscles causes flexion or flattening of the lumbar spine.

The single drawing FIGURE illustrates a seat/chair 10 equipped with means for fixing or providing resistance against the fronts of the thighs proximate the knees while an individual is seated therein and allowing the upper or lumbar portions of the psoas major muscles to contract and function as lumbar flexors thus adjusting and controlling the alignment for better comfort. The restraining means illustratively has the form of a seat/chair thigh strap unit designed to fix or restrain the fronts or anterior portions of the thighs against upward movement when an individual is seated in the seat/chair 10. This unit comprises a cannister 12 housing a canvass or texture material flexible strap 14 wound around an inner retaining rod 16. This rod 16 can roll relative to the canister 12 and also be locked in a set or non-rolling position. The strap 14 rolled around the rod 16 has at its lead end a hook and loop self-fastening system 18.

The canister 12 is attached by a bracket on one side of the seat portion of the seat/chair 10. The canister bracket is positioned close to the outer edge 20 of seat portion of the seat/chair 10, as shown in the FIGURE. Thus, when an individual sits in the seat/chair 10, the flexible strap 14 can be made to engage over the anterior portion of the individual's thighs proximate his/her knees so as to maximize the effective lever arm of the thighs in contracting the paoas major muscles, as discussed above. A bar mounted on metal plate or brakcet 22 is attached to the other side of side/chair 10 directly across from the canister 12.

The individual seated in the seat/chair 10 with the thigh strap 14 in the recoil position simply reaches for the lead end of the strap 14, draws it out of the cannister 12 across the front of his/her thighs, and then loops the strap 14 around the mounted bar 22 on the opposite side of the seat/chair 10, pressing the hook and fastening the panels together to secure the strap 14 in place. This set position should cause the strap 14 to rest gently across his or her thighs just above his or her knees. The rod 16 in the canister 12 would then be set in the locked or non-rotatable position. To activate the system, the individual seated in the seat/chair 10 simply presses upwardly with his/her thighs against the locked strap 14, while pressing downwardly with the balls of his or her feet against the floor/ground on which the seat/chair 10 is supported. This cause the psoas major muscle to contract and with the thighs fixed by the strap 14 produces a flattening of the lumbar spine. This will allow the individual so seated to control the curvature of the lumbar spine by a very simple and not-at-all exertional maneuver. It utilizes extremely strong muscles (psoas major) to control the weight bearing alignment on the lumbar vertebrae. Adjustment of an accentuated lumbar lordosis or swayback to a more suitable normal postural attitude is produced by this system described. The unit is released by detaching the hook and loop fastening panels, and releasing the locking mechanism and the spring loaded rod 16 in the canister 12 will automatically reroll the strap 14.

The seat/chair 10 may be specially designed for use by individuals either at home or at their work place. In this case, the seat/chair 10 may be equipped with screw leg adjusting means 26, which allow the effective length of each leg of the seat/chair 10 to be adjusted, and means 24 which allow the effective depth of the seat portion of the seat/chair 10 to be adjusted relative to the heights of the canister 12 and cooperating bracket 22. Thus, the individual using such a specially designed seat/chair 10 may adjust it optimally to suit his or her own physical proportions. Alternatively, the seat/chair 10 may be a conventional such seat/chair in an automobile, airplane or the like optionally equipped with a seat/chair thigh strap unit of the type described proximate the outer edge 20 of the seat portion thereof.

It will thus be appreciated that the invention may be used in a variety of environments and circumstances to assist in maintaining optimum lumbar spinal alignment and in relieving chronic backache. It derives from a recognition that the psoas major muscle is an effective lever arm flexor of the lumbar spine when the lower attachment to the lesser trochanter of the femur can be fixed by pressure on the front or anterior portions of the thighs proximate the knees.

I claim:

1. Apparatus for achieving and maintaining optimum lumbar spinal alignment in a human subject comprising seat/chair means having a seat portion with an inner edge and an outer edge, and a back rest portion disposed at an angle at the inner edge of said seat portion, said seat portion being adapted to be supported on a generally horizontal support so as to permit the human subject to recline in said seat/chair in a seated position with his/her thighs generally parallel to said support, means positioned proximate the outer edge of the seat portion of said seat/chair for restraining anterior portions of the human subject's thighs proximate the human subject's knees from upward movement relative to said support, thereby permitting the human subject, while reclined in said seat/chair means in a seated position, to force his/her thighs upwardly against said restraining means and the balls of his/her feet downwardly against said horizontal support, thus causing contraction of his/her psoas major muscles and a flattening of his/her lumbar spine.

2. Apparatus as recited in claim 1 in which said restraining means comprises flexible strap means having a first end attached to a first side of the seat portion of said seat/chair means at the outer edge thereof and a second end removably attachable to a second, opposite side of the seat portion of said seat/chair means at the outer edge thereof, so as to permit said strap means to be removably disposed across the anterior portions of the human subject's thighs in the vicinity of his/her knees.

3. Apparatus as recited in claim 2 in which said seat/chair means includes means for adjusting the effective height of the seat portion thereof relative to said horizontal support.

4. Apparatus as recited in claim 2 in which said seat/chair means include means for adjusting the effective depth of the seat portion thereof relative to the points of attachment of said first and second ends of said flexible strap means.

5. A method of achieving and maintaining optimum lumbar spinal alignment in a human subject comprising the steps of causing the human subject to recline in a seated position in seat/chair means with his/her thighs in a position generally parallel to a horizontal support supporting said seat/chair means, restraining anterior portions of the human subject's thighs proximate the human subject's knees from upward movement relative to the horizontal support through the use of retraining means attached to said seat/chair means, and causing the human subject to force his/her thighs upwardly against said restraining means and to force the balls of his/her feet downwardly against the horizontal support, thus causing contraction of his/her psoas major muscles and a flattening of his/her lumbar spine.

6. The method described in claim 5 wherein said restraining step comprises the step of strapping the anterior portions of the human subject's thighs relative to said seat/chair means through the use of a flexible strap attached to said seat/chair means so as to be disposed proximate the human subject's knees.

* * * * *